US006783394B1

(12) United States Patent
Holliday

(10) Patent No.: US 6,783,394 B1
(45) Date of Patent: Aug. 31, 2004

(54) UNIVERSAL MULTI-STAGE COMPRESSION CONNECTOR

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

(21) Appl. No.: 10/391,026

(22) Filed: Mar. 18, 2003

(51) Int. Cl.[7] ..... H01R 9/05
(52) U.S. Cl. ..... 439/578
(58) Field of Search ..... 439/578, 584, 439/585

(56) References Cited

U.S. PATENT DOCUMENTS

| | | | | |
|---|---|---|---|---|
| 3,184,706 A | | 5/1965 | Atkins | 439/584 |
| 4,655,159 A | | 4/1987 | McMills | 439/578 |
| 5,024,606 A | | 6/1991 | Ming-Hwa | 439/578 |
| 5,073,129 A | | 12/1991 | Szegda | 439/555 |
| 5,470,257 A | | 11/1995 | Szegda | 438/578 |
| 5,564,942 A | | 10/1996 | Lee | 439/462 |
| 5,586,910 A | | 12/1996 | Del Negro et al. | 439/584 |
| 5,667,405 A | | 9/1997 | Holliday | 439/585 |
| 5,899,769 A | | 5/1999 | Konetschny et al. | 439/394 |
| 5,997,350 A | * | 12/1999 | Burris et al. | 439/585 |
| 6,089,913 A | | 7/2000 | Holliday | 439/584 |
| 6,153,830 A | | 11/2000 | Montena | 174/88 |
| 6,217,383 B1 | * | 4/2001 | Holland et al. | 439/578 |
| 6,425,782 B1 | * | 7/2002 | Holland | 439/585 |
| 6,530,807 B2 | * | 3/2003 | Rodrigues et al. | 439/578 |

FOREIGN PATENT DOCUMENTS

GB 2277207 A 10/1994

* cited by examiner

*Primary Examiner*—Tulsidas C. Patel
(74) *Attorney, Agent, or Firm*—John E. Reilly

(57) ABSTRACT

In a coaxial cable TV connector, a universal crimping ring assembly is made up of axially offset crimping members arranged in telescoping relation to one another and to a crimpable sleeve into which the coaxial cable is inserted, and the crimping rings are preassembled onto the sleeve and have at least one tapered surface portion between them so that when the crimping rings are axially advanced over the outer sleeve will cause inward radial deformation of the outer sleeve into sealed engagement with an external surface of the cable.

31 Claims, 4 Drawing Sheets

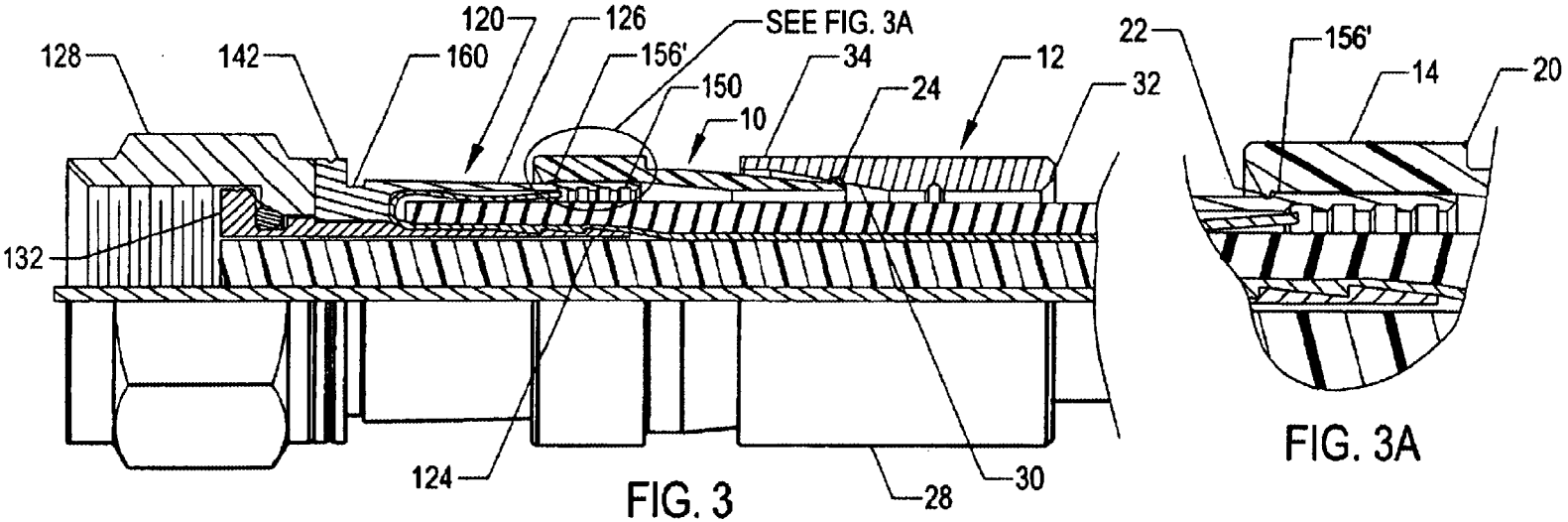
FIG. 3A
FIG. 3
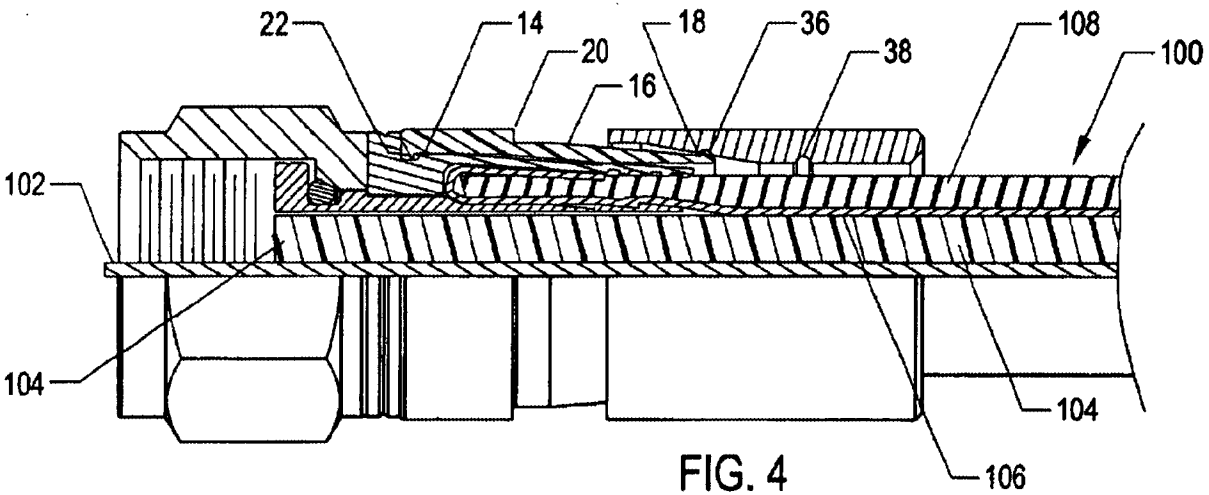
FIG. 4

UNIVERSAL MULTI-STAGE COMPRESSION CONNECTOR

BACKGROUND AND FIELD OF INVENTION

This invention relates to cable connectors; and more particularly relates to a novel and improved compression-type connector in which a single size connector is capable of accommodating a wide range of cable sizes.

A problem which has confronted the cable T.V. industry for years has been to provide a single connector size which can accommodate a plurality of different-sized cables. The standard coaxial cable is made up of a center conductor, insulated layer surrounding the conductor, foil layer, braided layer and outer jacket. This is a typical dual shield cable having a single braided layer which is the outer conductor. Depending upon the specific application and frequencies being transmitted through the cable, it is necessary to modify the thickness of the braided layers, and consequently there are dual-shield, tri-shield and quad-shield cables. For example, the quad-shield cable has two braided layers separated by a foil layer. Also, the braided layer may vary in thickness depending upon the frequencies being handled.

U.S. Pat. Nos. 5,863,220 and 6,089,913 disclose coaxial cable connectors that have a crimping ring preassembled onto the connector, and the end of the cable has to be inserted through the single crimping ring and into the inner concentric sleeves on the connector. There are definite size limitations imposed on the diameter of the crimping ring to ensure that it is small enough in diameter to effect the necessary inward contraction on the outer sleeve of the connector to result in a good crimp. This means that the pull-out force necessary to separate the cable from the connector is in excess of 40 psi, and the cable should be contracted enough to assure that there is substantially no leakage or frequency loss between the braided layer(s) and the connector. At the same time, the degree of compression must not be so great as to cause the inner sleeve to collapse or be damaged or otherwise result in an impedance problem in the higher frequency ranges. Especially in larger cables, there is real difficulty in reaching a compromise between the optimum inner diameter of the crimping ring which will permit the cable to be easily inserted into the connector sleeve and the size necessary to effect a good crimp. Since the crimping is most important to assure a good connection, typically the inner diameter of the crimping ring is such that it is very difficult to insert the cable into the connector sleeve. This requires manual dexterity on the part of the installer and, after a day of making connections, can be extremely time-consuming, difficult and very tiring.

Accordingly, for professional installers and home users alike, it is desirable to provide a preassembled crimping ring assembly for a compression-type connector which is conformable for use with a wide range in sizes of coaxial cables either for the purpose of splicing cables together or for connecting one cable end to a terminal and nevertheless be capable of achieving the desired sealed mechanical and electrical connection therebetween.

SUMMARY OF THE INVENTION

An object of this invention is to provide for a novel and improved compression-type coaxial cable connector which is readily conformable for use in connecting different size cables either to a terminal or to another connector in a highly efficient and reliable manner.

Another object of the present invention is to provide for a novel and improved end connector for coaxial cables with a self-contained crimping ring assembly to achieve the necessary sealed mechanical and electrical connection between the cable and the terminal or to another cable; and wherein the crimping ring assembly is so constructed and arranged as to bring about the necessary inward radial deformation or compression of the connector into crimping engagement with the cable in response to axial advancement of the crimping ring assembly with existing compression tools.

A further object of the present invention is to provide for a novel and improved cable connector with pre-assembled crimping ring assembly which will effect sealed engagement between the connector and cable in a minimum number of steps and simplified manner.

In accordance with the present invention, a two-stage connector has been devised for mechanically and electrically connecting a cable having a first electrically conductive member to a second electrically conductive member, the connector having a connector body, an outer sleeve extending from an end of the connector body for insertion of an end of the cable therein, a first crimping member having an annular portion including a first inner diameter at least as great as an outer diameter of said outer sleeve and disposed in outer surrounding relation to the outer sleeve, and a second crimping member having a tapered annular portion at least partially overlying the first crimping member wherein slidable axial advancement of the second crimping member and the first crimping member with respect to the outer sleeve will impart radial deformation to the outer sleeve into sealed engagement with an external surface of the cable. Most desirably, the second crimping member has its tapered annular portion extending from a first diameter at least as great as the outer diameter of the outer sleeve to a second diameter less than the outer diameter of the outer sleeve but greater than an inner diameter of the outer sleeve, and the innermost diameter of the first crimping member is also at least as great as the inner diameter of the outer sleeve in order to accommodate different sizes of cable as well as to achieve a higher degree of compression and pull out strength. The preferred form of invention is specifically adaptable for use with coaxial TV cable connectors for terminating a wide range of cable sizes or diameters depending upon the particular application and frequency transmitted.

The above and other objects, advantages and features of the present invention will become more readily appreciated and understood from the following description of preferred and alternative forms of the present invention when taken together with the accompanying drawings, in which:

BRIEF DESCRIPTION OF THE DRAWINGS

FIG. 3 is an elevational view partially in section of the preferred form of invention loosely assembled onto the end of a coaxial cable;

FIG. 3A is a detailed view of the leading end of the first crimping ring;

FIG. 4 is another view partially in section of the preferred form as shown in FIG. 2 at the beginning of a crimping operation;

DESCRIPTION OF PRIOR ART

Figure 1:
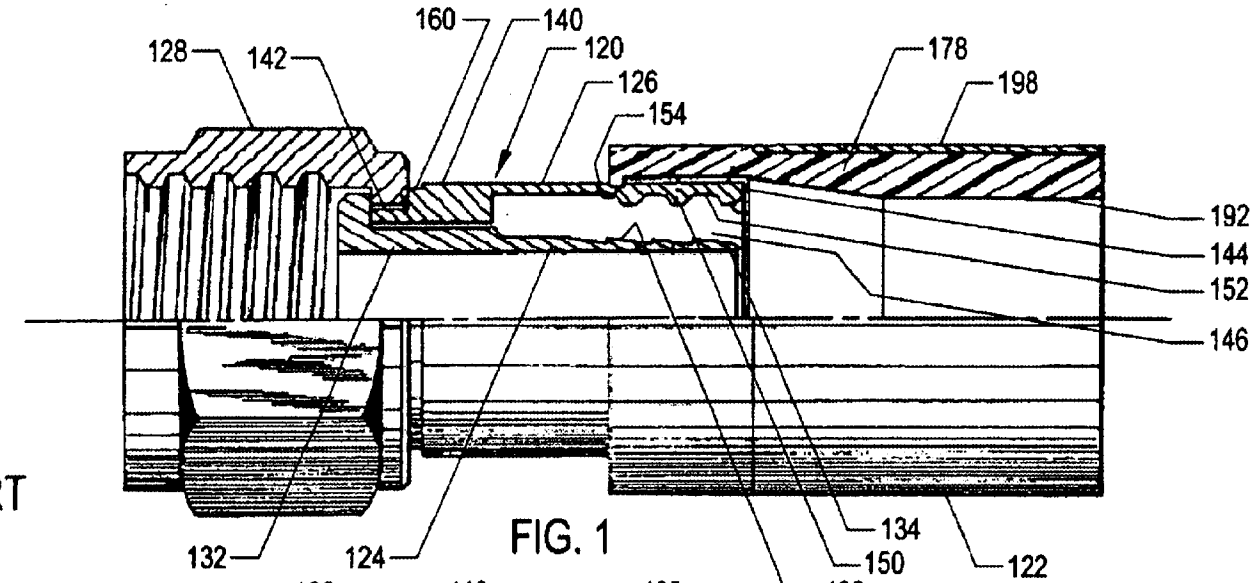
FIG. 1 PRIOR ART
FIGS. 1 and 2 are partial sectional views of a standard end connector with preinstalled crimping ring labeled as "prior art"
Figure 2:
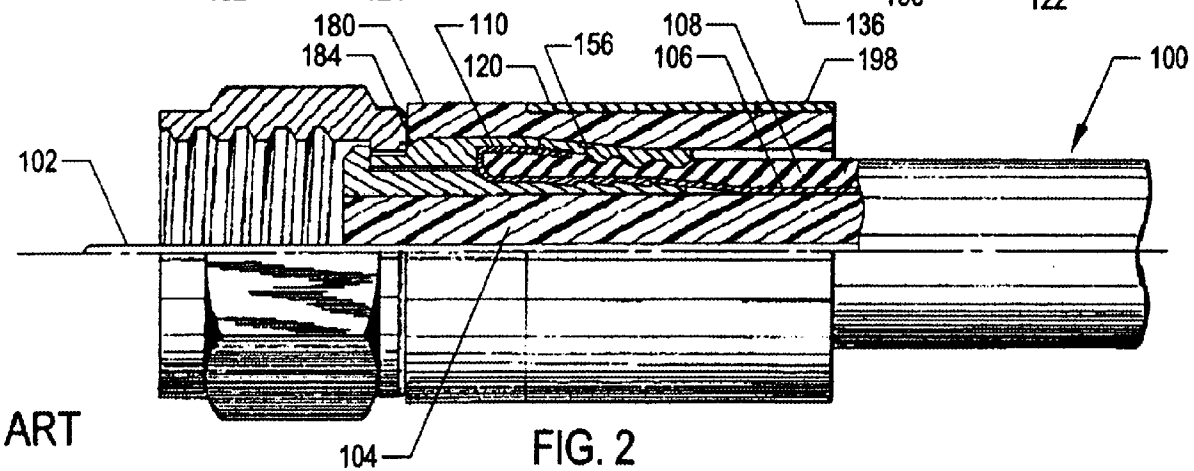
FIG. 2 PRIOR ART

Referring in more detail to the drawings, there is shown by way of illustrative example in FIGS. 1 and 2 a standard form of coaxial cable 100 attached to an end connector 120 in accordance with the teachings of U.S. Pat. No. 6,089,913 for End Connector and Crimping Tool for Coaxial Cable. As a setting for the present invention, the coaxial cable 100 is made up of an inner conductor 102, a dielectric insulator 104, outer braided conductor layer 106, and a dielectric outer layer jacket 108 of rubber or rubber-like material. Typically, foil layers are interposed between the inner conductor 102 and insulator 104 as well as between the braided layer 106 and the jacket 108. The end of the cable 100 to be inserted into the connector 120 is prepared by removing limited lengths of the insulator 104, braided layer 106 and jacket 108 from the end of the cable 100 to expose an end portion of the conductor 102; and a portion of the braided layer 106 which extends beyond the outer jacket 108 is folded back over a forward end of the jacket 108 as illustrated in FIG. 2. Cable diameters or sizes vary according to the application and the frequencies being transmitted through them, for example, when used to connect to a TV terminal or post. In particular, one or more braided layers 106 are employed depending upon the frequencies being handled and can result in a variation in diameter of the cable 100 on the order of 0.024 in. Thus, in an RG6 cable the braided layer may vary in thickness from that of a 60% braided layer up to a quad-shield layer.

A standard coaxial cable end connector 120 is illustrated in FIGS. 1 and 2 for installation of the cable 100 by means of a crimping ring 122 in a manner set forth and described in more detail in U.S. Pat. No. 6,089,913. The end connector 120 is comprised of an inner concentric sleeve 124 having a shoulder 132 at its forward end, and an outer sleeve 126 extends rearwardly from a body 140 and a reduced forward end 142 which bears against the shoulder 132. A threaded fastener 128 has a rearward end that is interpositioned between the shoulder 132 and body 140, the fastener 128 being internally threaded for connection to a post or terminal on a television set. An exterior surface of the fastener 128 includes a plurality of flats 170 for engagement by a tool, such as, a crescent wrench and the flange 164 at the rear end of the fastener 128 permits the fastener 128 to be rotated independently of the shoulder 132 and the connector body 140.

The outer sleeve 126 has a trailing end 144 of reduced diameter and thickness relative to the body 140, and an annular space 146 is formed between the trailing end 144 and trailing end 134 of the inner sleeve 124. An inner wall surface of the trailing end 144 includes a plurality of endless sealing rings 150 extending in a circumferential direction about the inner wall surface in facing relation to serrations 136 on the outer wall surface of the sleeve 124. The rings 150 define a series of equidistant grooves 152 between the rings 150, and the exterior surface 154 is substantially smooth and of uniform diameter except for the groove 156 which is spaced from the rear end 144. Another groove 160 is disposed at the leading end of the exterior surface of the connector body 140.

The crimping ring 122 is dimensioned such that the portion 180 fits over the rear end 144 of the outer sleeve 126 until the rib 184 enters the groove 156, as shown in FIG. 1. The leading end of the tapered surface 188 abuts the rear end 144, and the cylindrical portion 190 is dimensioned to be equal to or of a slightly greater diameter than the inner diameter of the rings 150 so that a leading end of the cable 100 can be inserted into the connector 120 in a manner to be described.

In utilizing a single preinstalled crimping ring 122, the end of the cable 100 is inserted into the crimping ring 122 and the end connector 120, as shown in FIG. 2. The exposed inner conductor 102 and dielectric insulator 104 extend through the inner sleeve 124 so that a forward end of the insulator 104 abuts the shoulder 132, and the end of the inner conductor 102 extends to at least the forward end 168 of the fastener 128. The remaining portions of the cable 100 consisting of the braided layer 106, foil layers, and the outer jacket 108 extend through the annular space 146 between the trailing ends 134 and 144 of the inner and outer sleeves 124 and 126, respectively, until the folded over portion 110 abuts the rear end of the body 140, as shown in FIG. 2. Once the cable 100 has been fully inserted through the crimping ring 122 and into the end connector 120, the combination of the end connector 120, ring 122 and cable 100 are placed in a standard compression tool, such as, the tool of my hereinbefore referred to U.S. Pat. No. 6,089,913. The tool is operative to advance the ring 122 axially over the connector 120 in order to force the rib 184 of the leading end 180 from the rear groove 156 and cause the tapered surface 188 to radially compress or crimp the thin-walled trailing end 144 of the sleeve 126 about the jacket 108 of the cable 100. The resilient material of the jacket 108 will fill the grooves 152 to form watertight seals between the jacket 108 and the rings 150 to prevent moisture or other contaminants from penetrating the space 146.

Under continued pressure from the crimping tool, the ring 122 is driven axially until a forward end face 114 of the ring 122 contacts the rear flange 164 of the fastener 128 and the rib 184 of the 122 leading end 180 seats within the second groove 160, as shown in FIG. 2. Once the leading end of the ring 122 is secured within the annular groove 160, the end connector 120, ring 122 and cable 100 are removed from the tool.

In using the single crimping ring 122 as described, extremely close tolerances must be maintained between the ring 122, the outer sleeve 128 and the cable 100. Thus, the inner diameter 192 of the ring 122 must be greater than the outside diameter of the cable end 100 in order that the cable end 100 can be inserted as illustrated in FIG. 2 with the jacket 108 and braided portion 110 fully inserted between the inner and outer sleeves. On the other hand, the degree of taper must be sufficient to ensure that the outer sleeve 126 can be contracted inwardly to the extent necessary to ensure that the outer jacket 108 fills the grooves 152 between the endless rings 150 on the interior surface of the outer sleeve 126, or at least substantially so, so as to ensure sealed engagement. As a rule of thumb for establishing the inner diameter of the crimping ring 122, it must be at least as great as the outside diameter or size of the cable end 100 but less than the diameter of the grooves 152 of the sleeve 126; and the degree of taper must establish a reduction in diameter from the leading end 154 of the ring 122 which exceeds that of the outer sleeve 126 and the inner diameter surface portion 192 of the ring 122.

DETAILED DESCRIPTION OF PREFERRED EMBODIMENT

Figure 5:
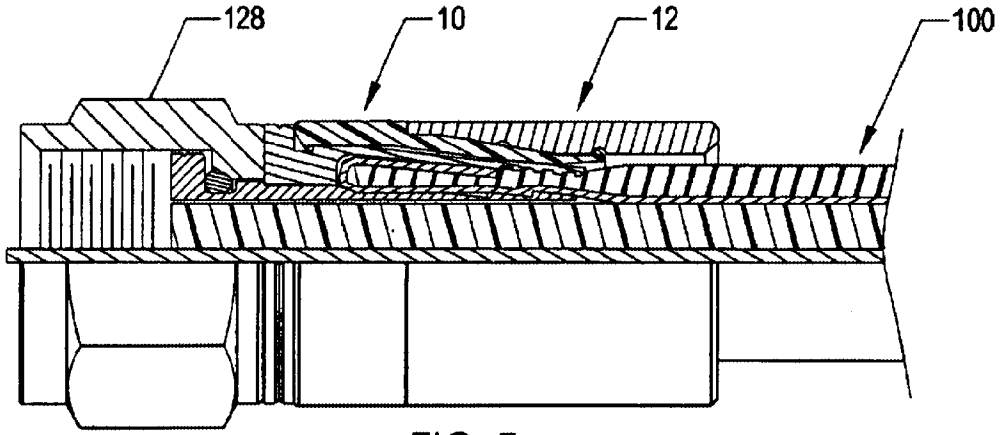
FIG. 5 is still another view similar to views 2 and 3 but illustrating the connector at the completion of the crimping operation.
Figure 6:
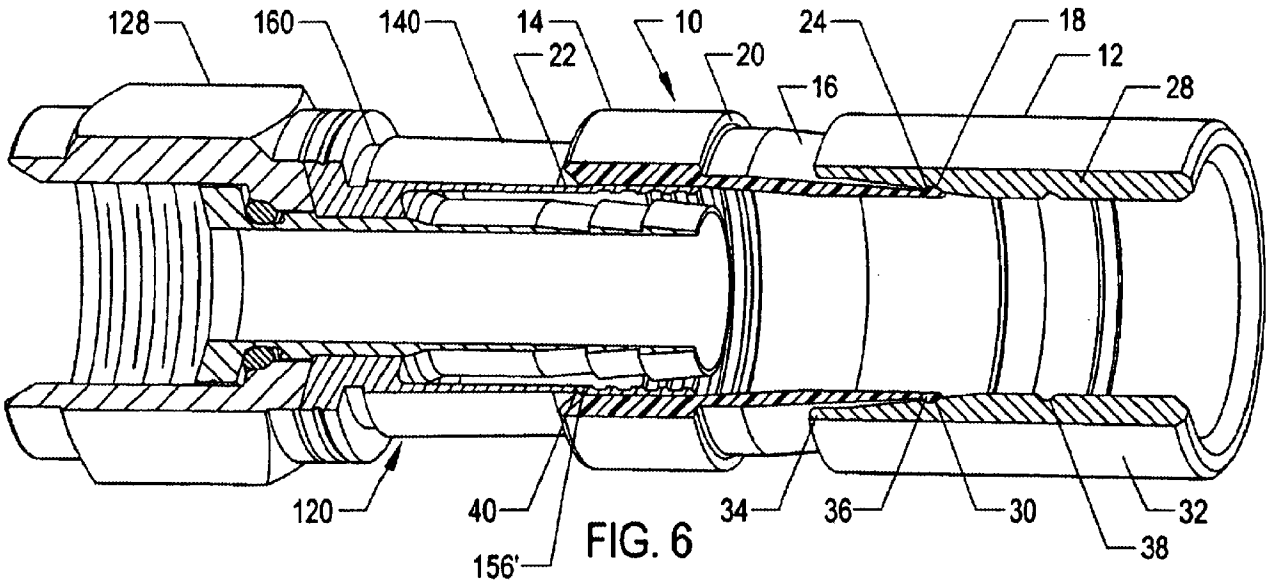
FIG. 6 is a cut-away view of a preferred form of a coaxial cable connector in accordance with the present invention.

An important feature of the present invention resides in the utilization of first and second crimping rings 10 and 12 in place of a single crimping ring, such as, the ring 122 of FIGS. 1 and 2. When used with the connector 120, as shown in FIGS. 3 to 5, the rings 10 and 12 are pre-assembled in axially offset relation to one another and to the outer sleeve 126 of the connector 120. The first crimping ring 10 includes a straight cylindrical portion 14 of uniform thickness and a relatively thin-walled cylindrical portion 16 which tapers rearwardly from the portion 14 and terminates in a trailing end 18. The cylindrical portion 14 terminates in the external shoulder 20 at its juncture with the tapered portion 16, and at its leading beveled end has a circumferential rib or shoulder 22 extending radially inwardly for engagement with outer sleeve 126.

The first crimping ring member 10 is preferably composed of a plastic material, such as, DELRIN® having sufficient resiliency as well as compressibility that the leading end can be expanded slightly to permit the rib 22 to slide over the external surface of the outer sleeve 126 and snap into position against a shoulder 156' in place of the groove 156 in the outer sleeve 126, for example, as illustrated in FIG. 3. In addition, the elongated tapered portion 16 undergoes a slight reduction in diameter from the shoulder 20 to the trailing edge 18 and has a radially outwardly projecting circumferential rib 24 adjacent to its trailing edge 18.

The second crimping ring 12 includes an annular body 28 having a forwardly tapered inner wall surface 30 between a relatively thick-walled cylindrical portion 32 at its rear end and a relatively thin-walled cylindrical portion 34 at its leading end. The leading end 34 and tapered wall surface 30 are dimensioned to fit snugly over the trailing end 18 of the tapered wall portion 16 of the first crimping member when assembled onto the connector 120. A circumferential groove 36 in the tapered wall surface 30 is adapted to receive the rib 24 on the first crimping member in order to releasably connect the first and second crimping rings 10 and 12 together when pre-assembled onto the connector 120. A second groove 38 is axially spaced from the groove 36 in the inner wall surface of the cylindrical portion 32 to engage the rib 24 when the second crimping ring 12 is axially advanced over the first crimping ring 10 in a manner to be described.

Figure 7:
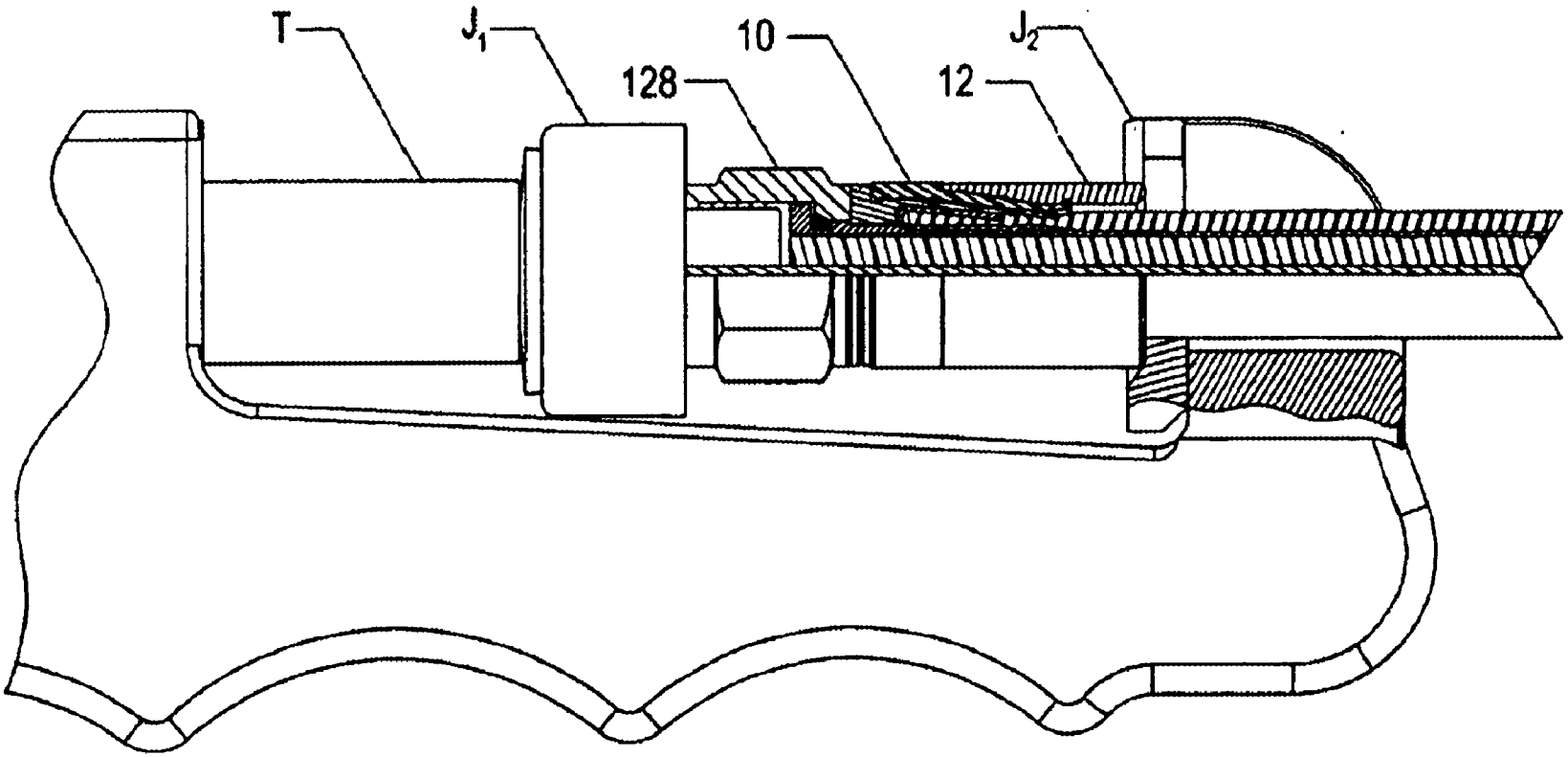
FIG. 7 is a fragmentary view partially in section of the preferred form of connector at the end of a crimping operation in a crimping tool.

In practice, by providing dual crimping rings 10 and 12 with the second crimping ring 12 partially overlying the first crimping ring 10 in preassembled relation to the connector 120, the rings 10 and 12 can be advanced over the outer sleeve 126 with a standard compression tool, such as, the tool illustrated in U.S. Pat. No. 6,089,913. Another type of hand-operated crimping tool T is illustrated in FIG. 7 which is a lengthwise compliant tool having jaws $J_1$ and $J_2$ which can be opened wide enough to apply an axial compressive force between the end of the second crimping ring 12 and the fastener 128. In addition, the inner diameters of the crimping rings 10 and 12 and particularly the inner diameter of the first crimping ring 10 can be enlarged in comparison to that of a single crimping ring 122 of the standard connector shown in FIGS. 1 and 2 so as to permit insertion of larger cables 100 into the connector 120.

A leading end of the cable 100 to be connected is first prepared in the standard manner to expose an end of the conductor 102 and folding back a portion of the braided layer 106 over the leading end of the jacket 108. The cable end 100 is inserted into position between the inner and outer sleeves 124 and 126 as shown in FIG. 3, the conductor 102 and insulator 104 projecting beyond the inner sleeve 124. When the tool T is initially squeezed to axially advance the crimping rings 10 and 12 in the same direction, as shown in FIG. 4, the first crimping ring 10 will be free to slide forwardly until the rib 22 moves into engagement with the groove 160 and the end of the cylindrical portion 14 abuts the end of the fastener 128. Under continued squeezing of the jaws $J_1$ and $J_2$, as shown in FIG. 7, the groove 36 will be forced axially away from engagement with the rib 24 as the tapered surface 30 on the second crimping ring 12 is advanced along the tapered surface 16 of the first crimping ring 10 until the leading end 34 moves into abutment with the shoulder 20 on the first crimping ring. Advancement of the tapered surface 30 as described along the tapered surface 16 will impart inward radial deformation to the outer sleeve 126 causing it to be crimped firmly into engagement with the outer covering 108, and the resilient material of the covering 108 will fill the grooves 152 between the sealing rings 150 so as to effect a water-tight seal.

It is to be understood that it is not essential to the crimping operation that the crimping rings 10 and 12 move successively forward over the outer sleeve 126. For example, as illustrated in FIGS. 3 to 6, the external shoulder 156' on the sleeve 126 will prevent the crimping ring 10 from accidentally sliding in a rearward direction once the rib 22 is axially advanced forwardly past the shoulder 40, as best seen from FIG. 6. However, the first gripping ring 10 will be free to advance or slide forwardly along the outer sleeve 126 until it encounters sufficient resistance that the second crimping ring 12 and specifically the rib 24 will escape from the groove 36 to permit axial advancement of the second crimping ring 12. Similarly, a groove 156 as shown in FIGS. 1 and 2 of the Prior Art may be utilized in place of the external shoulder 156' to increase the initial resistance to movement of the crimping ring 10 with respect to the outer sleeve 126. In this relationship, when the crimping rings 10 and 12 are axially compressed, they will simultaneously advance in a forward direction until the rib 22 moves into engagement with the forward groove 160 and the rear groove 38 moves into engagement with the rib 24 at the trailing end of the crimping ring 10. Furthermore, it is not essential that the thin-walled portion 16 of the crimping ring 10 be rearwardly tapered, but may be of uniform wall thickness as long as the crimping ring 12 is tapered as 30. In fact, it is essential only that one of these surface 16 and 30 be tapered to impart the necessary inward radial deformation to the outer sleeve 126.

Referring to FIGS. 1 and 7, the inner diameter 192 of the crimping ring 122 must be less than the outer diameter of the outer sleeve 126 and small enough to impart inward radial deformation of the sealing rings 150 into the outer jacket 108. This presupposes that the size of the cable 100 is such that the outer jacket is in contacting relation to the sealing rings 150 when inserted into the connector prior to the crimping operation. Otherwise, if any spacing remains between the jacket 108 and endless rings 150, the amount of radial deformation of the sleeve 126 would not be sufficient to cause the jacket to completely fill the grooves between the sealing ribs 150. The utilization of the two-stage compression rings 10 and 12 as described effectively permits the inner diameter of the ring 12 to be increased by an amount equal to the thickness of the crimping end 16 of the ring 10; and of course the inner diameter of the ring 10 prior to crimping is greater than the inner diameter of the ring 12. Not only does this permit the ring assembly to accommodate different-sized cables but can achieve a higher degree of compression and greater pull out strength. Stated another way, it is not essential that the diameter of the cable 100 be such that the outer jacket 108 will contact the inner surfaces of the sealing ribs 150 in order to achieve the desired degree of compression of the rib 150 into the jacket 108. Thus, the one size of connector 120 and compression rings 10 and 12 can be utilized with different cable types and sizes and particularly where the size will vary on account of changes to the outer braided layer 106. As a result, the connector 120 can accept a wider range of outside cable diameters when open or uncompressed and, when compressed, can create a smaller diameter and enable the connector to accommodate a wider range of cable sizes while achieving greater pull out strength and minimizing return losses.

It will be evident that the two-stage crimping ring assembly 10 and 12 is comformable for use with other types of fittings or connectors than the form illustrated in FIGS. 1 and 2 and may be effectively utilized with any type of cable connector having a radially inwardly deformable sleeve within which a cable end is inserted. Furthermore, two pairs of crimping rings 10 and 12 may be used at opposite ends of a connector which is adapted to splice a pair of cable ends together, such as for example, in the manner illustrated in FIGS. 10 and 11 of my hereinbefore referred to U.S. Pat. No. 6,089,913.

It is therefore to be understood that while a preferred form of invention are herein set forth and described, the above and other modifications and changes may be made therein without departing from the spirit and scope of the invention as defined by the appended claims and reasonable equivalents thereof.

I claim:

1. A multi-stage connector for mechanically and electrically connecting a cable having a first electrically conductive member to a second electrically conductive member, said connector comprising:

a connector body;

an outer sleeve member extending from an end of said connector body for insertion of an end of said cable therein;

a first crimping member having an annular portion including a first inner diameter at least as great as an outer diameter of said outer sleeve member and disposed in outer surrounding relation to said outer sleeve member; and a second crimping member having a tapered annular portion at least partially overlying said first crimping member wherein slidable axial advancement of said second crimping member with respect to said first crimping member and said first crimping member with respect to said outer sleeve member will impart inward radial deformation to said outer sleeve member into sealed engagement with an external surface of said cable.

2. A connector according to claim 1 wherein said second crimping member has a tapered annular portion extending from a first diameter at least as great as an outer diameter of said outer sleeve member to a second diameter less than said outer diameter of said outer sleeve member.

3. A connector according to claim 1 wherein said first crimping member has a tapered annular surface portion extending from a first diameter at least as great as an outer diameter of said outer sleeve member to a second diameter less than said outer diameter of said outer sleeve member but greater than an inner diameter of said outer sleeve member.

4. A connector according to claim 1 wherein said first crimping member includes an external shoulder at a leading end thereof.

5. A connector according to claim 4 wherein said second crimping member includes a leading end portion moveable into abutting relation to said shoulder in response to axial slidable advancement of said second crimping member with respect to said first crimping member.

6. A connector according to claim 1 wherein said first crimping member and said outer sleeve member have releasable connecting means therebetween whereby to releasably connect a leading end portion of said first crimping member to a trailing end portion of said outer sleeve member.

7. A connector according to claim 1 wherein said first and second crimping members have releasable connecting means therebetween whereby to connect a leading end portion of said second crimping member to a trailing end portion of said first crimping member.

8. A connector according to claim 1 wherein said first and second crimping members undergo successive axial advancement in the same direction with respect to said outer sleeve member.

9. A connector according to claim 1 wherein said first crimping member has a cylindrical portion at a leading end thereof in overlying relation to a said outer sleeve member, and a tapered annular portion extending rearwardly from said cylindrical portion.

10. A connector according to claim 9 wherein said second crimping member includes a tapered annular portion adjacent to a leading end thereof and a cylindrical portion extending rearwardly from said second crimping member tapered annular portion.

11. A two-stage connector for mechanically and electrically connecting a cable having a first electrically conductive member to a second electrically conductive member, said connector comprising:

a connector body;

an outer sleeve member disposed in outer concentric relation to one end of said connector body for insertion of an end of said cable therein;

a first crimping member having an annular portion including a first tapered annular portion and a leading end disposed in outer surrounding relation to said outer sleeve member; and a second crimping member having a second tapered annular portion tapering from a first diameter at least as great as an outer diameter of said first crimping member to a second diameter less than said outer diameter of said first crimping member wherein slidable axial advancement of said second crimping member and said first crimping member in the same direction with respect to said outer sleeve member will impart inward radial deformation of said outer sleeve member into sealed engagement with an external surface of said cable.

12. A connector according to claim 11 wherein said first tapered annular portion extends from a first diameter at least as great as an outer diameter of said outer sleeve member to a second diameter less than said outer diameter of said outer sleeve member.

13. A connector according to claim 11 wherein said first tapered annular surface portion converges rearwardly from a first inner diameter at least as great as an outer diameter of said outer sleeve member to a second inner diameter less than said outer diameter of said outer sleeve member but greater than an inner diameter of said outer sleeve member.

14. A connector according to claim 11 wherein said first crimping member includes an external shoulder at a leading end thereof.

15. A connector according to claim 14 wherein said second crimping member includes a portion moveable into abutting relation to said shoulder in response to axial slidable advancement of said crimping member with respect to said first crimping member.

16. A connector according to claim 11 wherein said first crimping member and said outer sleeve member have first releasable connecting means therebetween defined by at pair of axially spaced grooves and a complementary rib movable between said grooves whereby to releasably connect a leading end portion of said first crimping member to a trailing end portion of said outer sleeve member.

17. A connector according to claim 16 wherein said first and second crimping members have second releasable connecting means there between whereby to connect a leading end portion of said second crimping member to a trailing end portion of said first crimping member.

18. A connector according to claim 17 wherein at least one of said first and second releasable connecting means is defined by a pair of axially spaced grooves and a complementary rib movable between said axially spaced grooves.

19. A connector according to claim 11 wherein said first crimping member has a cylindrical portion at a leading end thereof in overlying relation to said outer sleeve member, and said first tapered annular portion converges rearwardly from said cylindrical portion.

20. A connector according to claim 19 wherein a straight cylindrical portion extends rearwardly from said second tapered annular portion.

21. In a connector for connecting a coaxial cable having inner and outer spaced concentric electrically conductive portions to another electrically conductive portion and wherein said connector is provided with a connector body having inner and outer spaced concentric sleeve members for insertion of said spaced electrically conductive portions, the improvement comprising:

a first crimping member having a rearwardly extending elongated annular portion including a first inner diameter at least as great as an outer diameter of said outer sleeve member and being disposed in outer surrounding relation to said outer sleeve member; and a second crimping member having a tapered annular portion at least partially overlying said rearwardly extending annular portion; and axial compression means for axially advancing said first and second crimping members over said outer sleeve member whereby to impart inward radial deformation to said outer sleeve member into sealed engagement with an external surface of said cable.

22. In a connector according to claim 21 wherein said first crimping member has an external shoulder extending forwardly from said rearwardly extending annular portion.

23. In a connector according to claim 22 wherein said external shoulder portion has an inner cylindrical portion having a diameter at least as great as an outer diameter of said outer sleeve member.

24. In a connector according to claim 23 wherein said first crimping member and said outer sleeve member have releasable connecting means therebetween for releasably connecting a leading end portion of said first crimping member to a trailing end portion of said outer sleeve member.

25. In a connector according to claim 21 wherein said first and second crimping members have releasable connecting means therebetween for connecting a leading end portion of said second crimping member in overlapping relation to said first crimping member.

26. In a connector according to claim 21 wherein said axial compression means is operative to cause successive axial advancement of said first and second crimping members in the same direction with respect to said outer sleeve member.

27. In a connector according to claim 21 wherein axial advancement of said second crimping member with respect to said first crimping member is operative to cause inward radial deformation of said first crimping member.

28. In a connector for connecting a coaxial TV cable to a terminal wherein said cable has an outer resilient jacket, inner and outer spaced electrically conductive portions and wherein said connector has a fastener for connection to said terminal and a body provided with inner and outer concentric sleeve members with axially spaced sealing ribs on an inner surface of said outer sleeve member for insertion of said inner electrically conductive portion within said inner sleeve member and insertion of said outer electrically conductive portion between said inner sleeve member and said outer sleeve member, the improvement comprising:

a first crimping member having an annular portion including a first inner diameter at least as great as an outer diameter of said outer sleeve member and a leading end portion disposed in outer surrounding relation to a trailing end portion of said outer sleeve member; and a second crimping member having a tapered annular portion extending rearwardly from a first diameter at least as great as an outer diameter of said first crimping member to a second diameter less than said outer diameter of said first crimping member but greater than said inner diameter of said outer sleeve member wherein slidable axial advancement of said second crimping member and said first crimping member with respect to said outer sleeve member will impart controlled inward radial deformation to said first crimping member and resultant inward radial deformation of said sealing ribs into sealed engagement with said outer resilient jacket.

29. In a connector according to claim 28 wherein said first crimping member includes an external shoulder portion at a leading end thereof, and said second crimping member includes a leading end portion moveable into abutting relation to said external shoulder portion when said second crimping member is axially advanced with respect to said first crimping member.

30. In a connector according to claim 29 wherein said first crimping member and said outer sleeve member have first releasable connecting means therebetween for releasably connecting said first crimping member to an outer surface of said outer sleeve.

31. In a connector according to claim 29 wherein said first and second crimping members have second releasable connecting means therebetween for connecting a leading end portion of said second crimping member to a trailing end portion of said first crimping member.

* * * * *